US005438157A

United States Patent [19]

Lace, Sr. et al.

[11] Patent Number: 5,438,157

[45] Date of Patent: Aug. 1, 1995

[54] ACOUSTIC PICK-UP ASSEMBLY FOR A STRINGED MUSICAL INSTRUMENT

[75] Inventors: deceased Lace, Sr., late of Huntington Beach, by Dorothy Lace, legal representative; Jeffrey J. Lace, Huntington Beach, both of Calif.

[73] Assignee: Actodyne General, Inc., Huntington Beach, Calif.

[21] Appl. No.: 4,421

[22] Filed: Jan. 14, 1993

[51] Int. Cl.[6] ..... G10H 3/18

[52] U.S. Cl. ..... 84/726

[58] Field of Search ..... 84/723, 725, 726, 728, 84/743; 324/207.21

[56] References Cited

U.S. PATENT DOCUMENTS

| | | |
|---|---|---|
| 2,089,171 | 8/1937 | Beauchamp . |
| 2,119,584 | 7/1938 | Knoblaugh . |
| 2,175,325 | 10/1939 | Sunshine . |
| 2,209,016 | 7/1940 | Dickerson . |
| 2,294,861 | 9/1942 | Fuller . |
| 2,445,046 | 7/1948 | Tinkham . |
| 2,557,754 | 6/1951 | Morrison . |
| 2,567,570 | 9/1951 | McCarty . |
| 2,573,254 | 10/1951 | Fender . |
| 2,612,541 | 9/1952 | DeArmond . |
| 2,683,388 | 7/1954 | Keller . |
| 2,725,778 | 12/1955 | Cronwell . |
| 2,764,052 | 9/1956 | McBride . |
| 2,817,261 | 12/1957 | Fender . |
| 2,892,371 | 6/1959 | Butts . |
| 2,896,491 | 7/1959 | Lover . |
| 2,909,092 | 10/1959 | DeArmond et al. . |
| 2,911,871 | 11/1959 | Schultz . |
| 2,968,204 | 1/1961 | Fender . |
| 2,976,755 | 3/1961 | Fender . |
| 3,066,567 | 12/1962 | Kelley, Jr. . |
| 3,183,296 | 5/1965 | Miessner . |
| 3,236,930 | 2/1966 | Fender . |
| 3,249,677 | 5/1966 | Burns et al. . |
| 3,290,424 | 12/1966 | Fender . |
| 3,417,268 | 12/1968 | Lace . |
| 3,483,330 | 12/1969 | Warner . |
| 3,530,228 | 9/1970 | Scherer . |
| 3,535,968 | 10/1970 | Rickard . |
| 3,541,219 | 11/1970 | Abair . |
| 3,571,483 | 3/1971 | Davidson . |
| 3,588,311 | 6/1971 | Zoller . |
| 3,602,627 | 8/1971 | McCammon . |
| 3,657,461 | 4/1972 | Freeman . |
| 3,668,295 | 6/1972 | Broussard . |
| 3,711,619 | 1/1973 | Jones . |
| 3,715,446 | 2/1973 | Kosinski . |
| 3,725,561 | 4/1973 | Paul . |
| 3,902,394 | 9/1975 | Stich . |
| 3,911,777 | 10/1975 | Rendell . |
| 3,916,751 | 11/1975 | Stich . |
| 3,962,946 | 6/1976 | Rickard . |
| 3,983,777 | 10/1976 | Bartolini . |
| 3,983,778 | 10/1976 | Bartolini . |
| 4,026,178 | 5/1977 | Fuller . |
| 4,056,255 | 11/1977 | Lace . |
| 4,133,243 | 1/1979 | DiMarzio . |

(List continued on next page.)

FOREIGN PATENT DOCUMENTS 0480432 4/1992 European Pat. Off. .

*Primary Examiner*—William M. Shoop, Jr.
*Assistant Examiner*—Jeffrey W. Donels
*Attorney, Agent, or Firm*—Bliss McGlynn

[57] ABSTRACT

An acoustic pick-up assembly for a stringed musical instrument having a plurality of moveable strings includes a structure forming a longitudinal channel. The pick-up assembly also includes magnet structures disposed in the channel and a coil structure disposed in the channel for receiving an induced voltage due to movement of the moveable strings across the magnetic field.

23 Claims, 4 Drawing Sheets

U.S. PATENT DOCUMENTS 4,184,399 1/1980 Zuniga .
4,220,069 9/1980 Fender .
4,222,301 9/1980 Valdez .
4,227,434 10/1980 DiMarzio .
4,268,771 5/1981 Lace .
4,269,103 5/1981 Underwood .
4,283,982 8/1981 Armstrong .
4,320,681 3/1982 Altilio .
4,364,295 12/1982 Stich .
4,372,186 2/1983 Aaroe .
4,379,421 4/1983 Nunan .
4,394,830 7/1983 Damiano .
4,433,603 2/1984 Siminoff .
4,442,749 4/1984 DiMarzio et al. .
4,463,648 8/1984 Fender .
4,472,994 9/1984 Armstrong .
4,501,186 2/1985 Ikuma .
4,524,667 6/1985 Duncan .
4,535,668 8/1985 Schaller .
4,580,481 4/1986 Schaller et al. .
4,624,172 11/1986 McDougall .
4,738,178 4/1988 Deering .
4,748,886 6/1988 De Byl .
4,809,578 3/1989 Lace, Jr. .
4,809,578 3/1989 Lace .
4,854,210 8/1989 Palazzolo ..... 84/725
4,878,412 11/1989 Resnick ..... 84/726
4,941,389 7/1990 Wendler .
5,041,784 8/1991 Griebeler ..... 324/207.21
5,148,733 9/1992 Beller ..... 84/725
5,221,805 6/1993 Lace ..... 84/726
5,252,777 10/1993 Allen ..... 84/726
5,292,998 3/1994 Knapp ..... 84/726

FIG 4
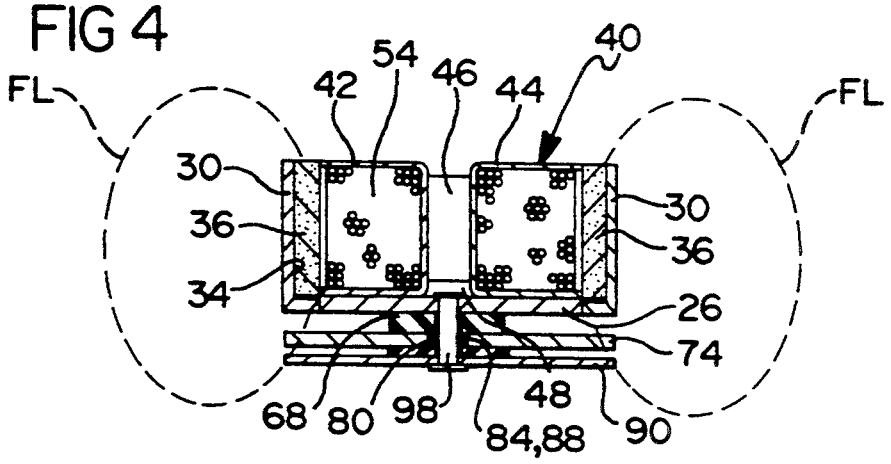
FIG 5
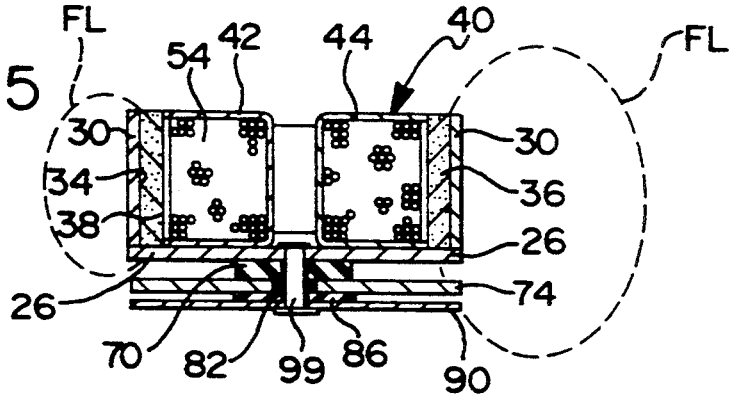
FIG 6
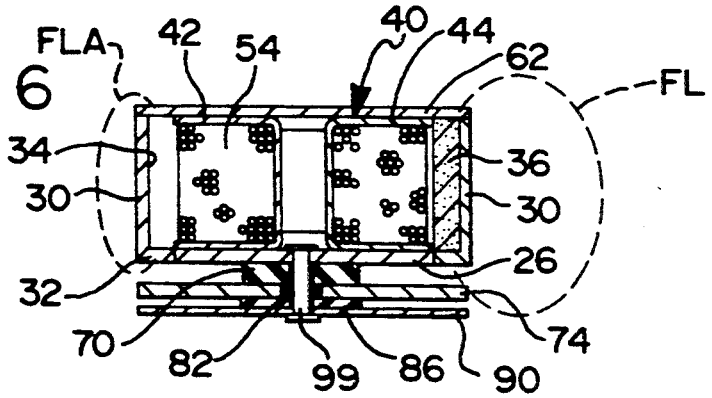
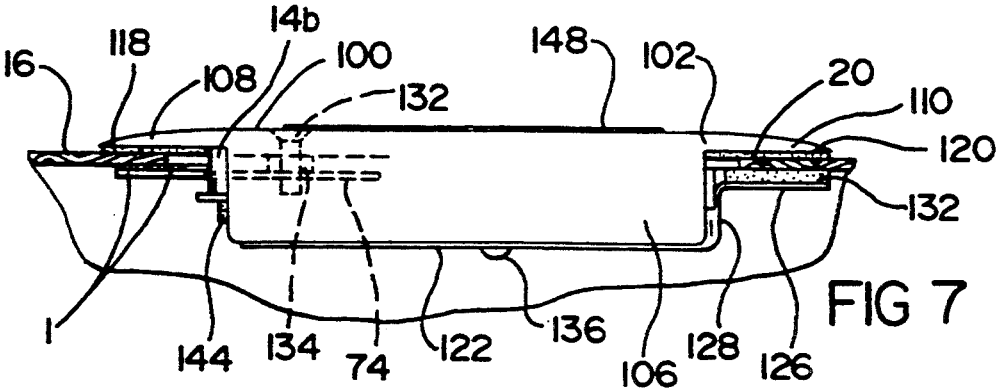
FIG 7

ACOUSTIC PICK-UP ASSEMBLY FOR A STRINGED MUSICAL INSTRUMENT

BACKGROUND OF THE INVENTION

1. Field of the Invention

The present invention relates generally to musical instruments and, more particularly, to an acoustic pick-up assembly for use with stringed musical instruments.

2. Description of the Related Art

Generally, stringed musical instruments such as an electric guitar have electromagnetic sensors or pick-ups for sensing mechanical vibrations of the strings and converting such into electrical signals. The electrical signals from the electromagnetic sensors or pick-ups are amplified and modified and, ultimately, reconverted into acoustical energy to produce music and the like.

An example of such an electromagnetic sensor or pick-up is disclosed in U.S. Pat. No. 4,809,578, issued Mar. 7, 1989, entitled "Magnetic Field Shaping In An Acoustic Pick-up Assembly", the disclosure of which is hereby incorporated by reference. This patented pick-up assembly includes an elongated ferromagnetic case lined on the interior thereof with planar permanent magnet pieces to present the same magnetic polarity into the interior thereof. The patented pick-up assembly also includes cores disposed in the interior of the case and having a plurality of coplanar, spaced, finger-like projections directed at the walls of the case. The walls and projections are permanently magnetized to a common magnetic polarity which will concentrate by magnetic repulsion flux into gaps between the projections. A coil is wound around the cores and the flux changes of these concentrated flux fields due to string motion induce a voltage in the coil. The coil has terminals connected to a socket in the stringed musical instrument for connection to an amplifier and speaker system.

Although the above patented pick-up assembly has worked well, it is typically used for an electric type of stringed musical instrument. As a result, the pick-up assembly is not used for an acoustic type of stringed musical instrument such as an acoustic guitar. Thus, there is a need in the art to provide a pick-up for an acoustic type of stringed musical instrument.

SUMMARY OF THE INVENTION

It is, therefore, one object of the present invention to provide an acoustic pick-up assembly for a stringed musical instrument.

It is another object of the present invention to provide an acoustic pick-up assembly for an acoustic type of stringed musical instrument.

It is yet another object of the present invention to provide an acoustic pick-up assembly which mounts in a sound hole of an acoustic type of stringed musical instrument.

It is still another object of the present invention to provide an acoustic pick-up assembly having a mounting assembly which is adjustable for location in a sound hole of an acoustic type of stringed musical instrument.

It is a further object of the present invention to provide an acoustic pick-up assembly having a sensor assembly which is adjustable relative to the strings of the stringed musical instrument.

It is yet a further object of the present invention to provide a new and improved acoustic pick-up assembly.

To achieve the foregoing objects, the present invention is an acoustic pick-up assembly for a stringed musical instrument having a plurality of moveable strings. The pick-up assembly includes means forming a longitudinal channel and magnet means disposed in the channel for producing a magnetic field. The pick-up assembly also includes coil means disposed in the channel forming means for receiving an induced voltage due to movement of the moveable strings across the magnetic field. The pick-up assembly further includes means for reducing the magnetic field along the channel to balance the induced voltage from the strings into the coil means and/or means for mounting the channel forming means in a sound hole of the stringed musical instrument.

One advantage of the present invention is that an acoustic pick-up assembly is provided for an acoustic type of stringed musical instrument. Another advantage of the present invention is that the acoustic pick-up assembly includes a mounting assembly which mounts in the sound hole of an acoustic type of stringed musical instrument and is moveable therein to adjust the location or position of the acoustic pick-up assembly. Yet another advantage of the present invention is that the acoustic pick-up assembly also includes a sensor assembly which is adjustable relative to the mounting assembly and to the strings of the stringed musical instrument. Still another advantage of the present invention is that the acoustic pick-up assembly provides greater sensitivity while substantially eliminating extraneous noise.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 4 is a sectional view taken along lines 4—4 of FIG. 2.

FIG. 5 is a sectional view taken along lines 5—5 of FIG. 2.

FIG. 6 is a sectional view taken along lines 6—6 of FIG. 2.

FIG. 7 is a sectional view taken along lines 7—7 of FIG. 1.

DESCRIPTION OF THE PREFERRED EMBODIMENTS

Figure 1:
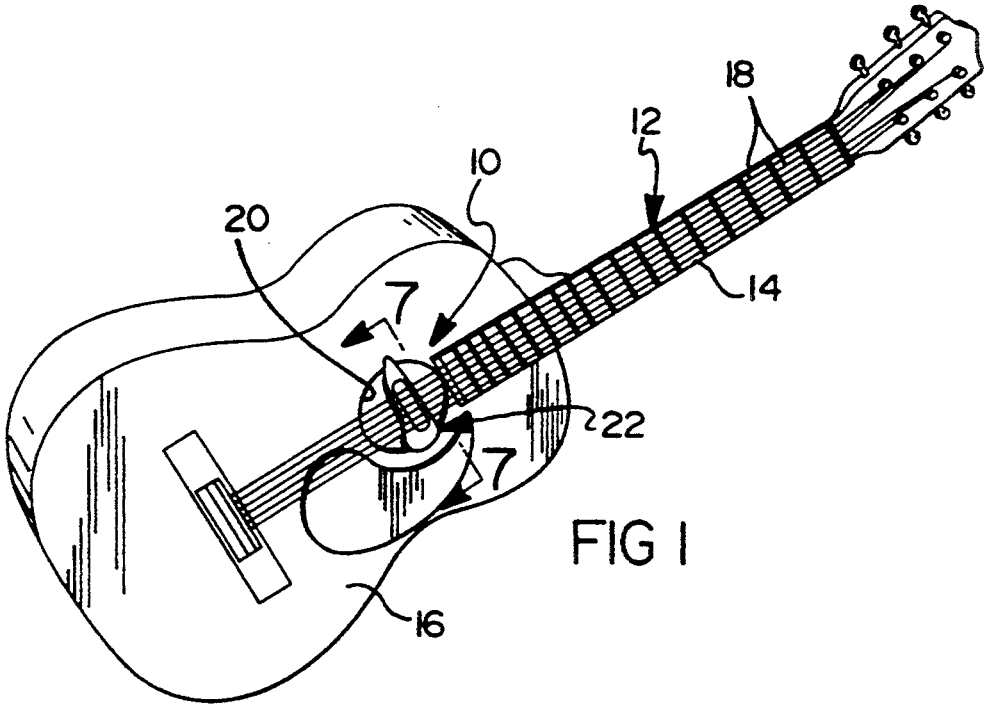
FIG. 1 is a perspective view of an acoustic pick-up assembly, according to the present invention, illustrated in operational relationship to a stringed musical instrument.

Referring to the drawings and in particular to FIG. 1, an acoustic pick-up assembly 10, according to the present invention, is illustrated in operational relationship with a stringed musical instrument such as a guitar, generally indicated at 12. The guitar 12 is of the acoustic type and has a neck portion 14, a body portion 16, a plurality of metal strings 18 such as steel strings extending along the neck and body portions 14 and 16, and a sound hole or aperture 20 extending through an upper portion of the body portion 16 beneath the strings 18. The sound aperture 20 is generally circular in shape. The acoustic pick-up assembly 10 is disposed in the sound hole 20 and mounted to the body portion 16 by a mounting assembly, generally indicated at 22, to be described.

Figure 2:
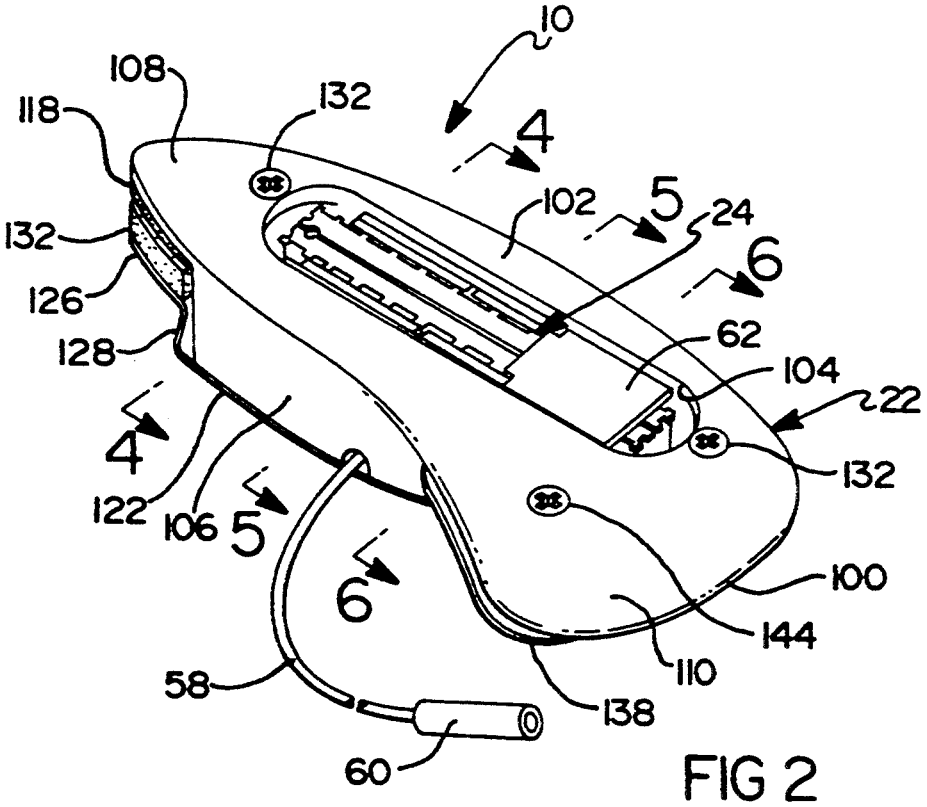
FIG. 2 is an enlarged perspective view of the acoustic pick-up assembly of FIG. 1.
Figure 3:
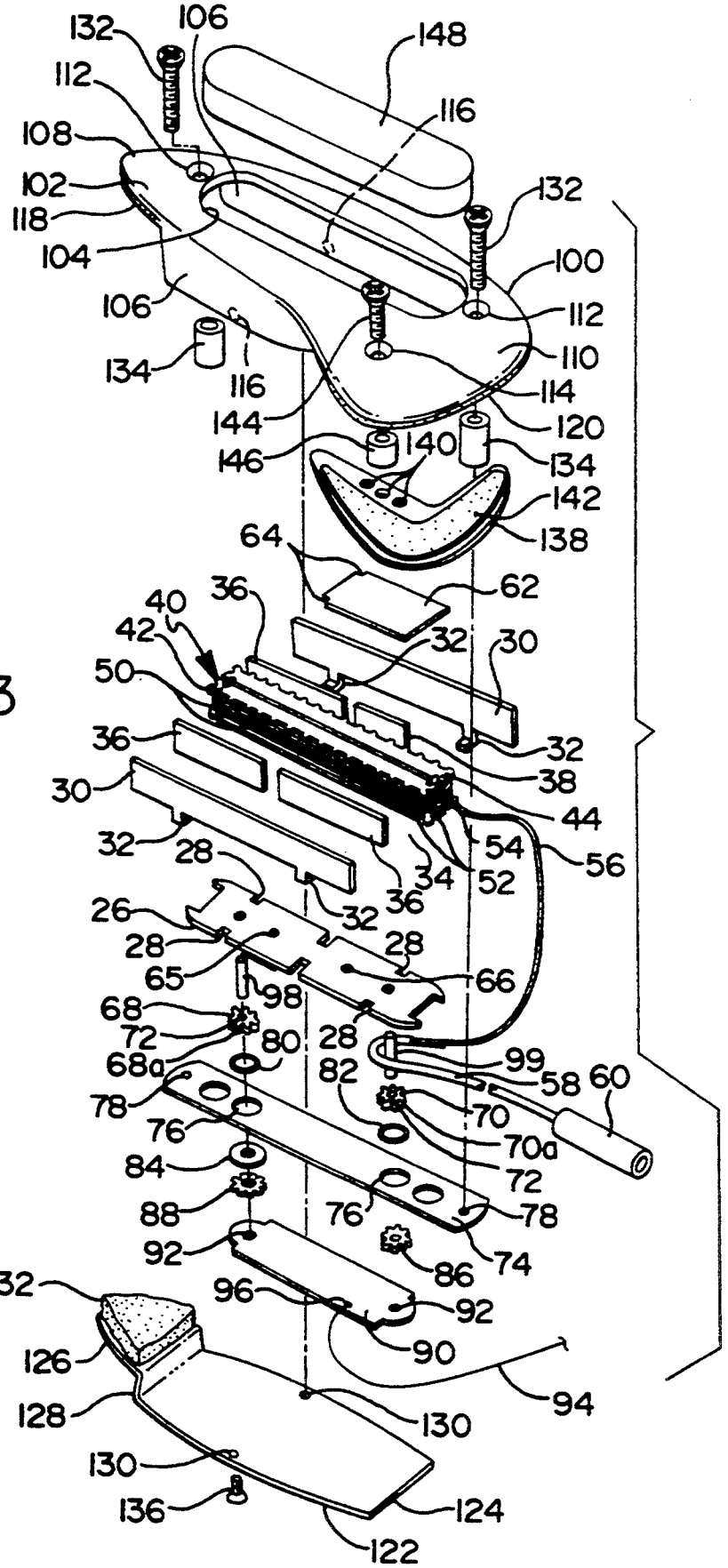
FIG. 3 is an exploded perspective view of the acoustic pick-up assembly of FIG. 2.

Referring to FIGS. 2 and 3, the acoustic pick-up assembly 10 includes a sensor assembly, generally indicated at 24, for sensing or picking-up vibrations of the strings 18 and converting the vibrations into electrical signals. The sensor assembly 24 includes an acoustic mount 26 extending longitudinally and having a generally rectangular shape. The acoustic mount 26 is also generally planar and has a pair of generally rectangular notches 28 extending inwardly and spaced longitudinally along each longitudinal edge. The sensor assembly 24 also includes an acoustic fence 30 disposed along each longitudinal side of the acoustic mount 26. The acoustic fence 30 extends longitudinally and has a generally rectangular shape. The acoustic fence 30 is also generally planar and has a pair of legs 32 being spaced longitudinally and having a general "L" shape. The legs 32 are disposed in the notches 28 such that the acoustic fences 30 are orientated substantially parallel to each other and perpendicular to the acoustic mount 26 to form a longitudinal channel 34 as illustrated in FIGS. 4 through 6. The acoustic mount 26 is made of a nonferromagnetic material such as aluminum and the acoustic fences 30 are made of a ferromagnetic material such as an iron based steel.

The sensor assembly 24 includes at least one generally planar first permanent magnet strip 36 disposed in the channel 34 and mounted to interior surfaces of each of the acoustic fences 30 by suitable means such as an adhesive bonding agent. The first permanent magnet strips 36 extend longitudinally and are generally rectangular in shape. The first permanent magnet strips 36 have a height equal to or slightly less than a height of the acoustic fences 30. Preferably, a plurality or two (2) first permanent magnet strips 36 are mounted to one of the acoustic fences 30 and one first permanent magnet strip is mounted to the other acoustic fence 30.

The sensor assembly 24 also includes at least one generally planar second permanent magnet strip 38 disposed in the channel 34 and mounted to the interior surface of the acoustic fence 30 having a single first permanent magnet strip 36 by suitable means such as an adhesive bonding agent. The second permanent magnet strip 38 extends longitudinally and is generally rectangular in shape. The second permanent magnet strip 38 has a longitudinal length less than the first permanent magnet strip 36. Preferably, the second permanent magnet strip 38 has a reduced magnetic force with respect to the first permanent magnet strip 36.

The first and second permanent magnet strips 36 and 38 are arranged to collectively present a common magnetic polarity facing the interior of the channel 34. The two (2) first permanent magnet strips 36 along one of the acoustic fences 30 are spaced longitudinally to cover the extent thereof. The first and second permanent magnet strips 36 and 38 along the other acoustic fence 30 are spaced longitudinally such that one end portion of the acoustic fence 30 has no magnet strip as illustrated in FIG. 6. The first and second permanent magnet strips 36 and 38 are arranged to present their north (N) magnetic polarity facing toward the interior of the channel 34 and their south (S) magnetic polarity impressed on the acoustic fences 30. It should be appreciated that the permanent magnet strips 36 and 38 may be arranged to present their (S) magnetic polarity facing toward the interior of the channel 34.

The sensor assembly 24 also includes a coil assembly, generally indicated at 40, disposed in the channel 34. The coil assembly 40 includes a pair of core or frame pieces 42 and 44 having a general "C" shape. The core pieces 42 and 44 are made of a ferromagnetic material such as an iron based steel. The core pieces 42 and 44 are orientated in a back to back relationship. The coil assembly 40 also includes at least one insulating spacer 46 disposed between the core pieces 42 and 44 to form a gap 48 therebetween such that the core pieces 42 and 44 do not directly contact each other. The core pieces 42 and 44 have a plurality of recesses 50 at exposed exterior edges thereof to define rows of tooth-like projections or teeth 52 for a function to be described.

The coil assembly 40 further includes a conductive wire such as copper wrapped or wound around the core pieces 42 and 44 to form a pick-up coil 54. The pick-up coil 54 has at least one lead 56 extending outwardly from one end thereof. The lead 56 is connected to a coaxial cable 58 which is, in turn, connected to a socket 60 on the guitar 12 for connection to an amplifier and speaker system (not shown). Preferably, the socket 60 accommodates a 0.25 inch plug (not shown). It should be appreciated that the pick-up coil 54 and coaxial cable 58 are mounted to a ground source (not shown).

The sensor assembly 24 also includes a damper 62 disposed adjacent the coil assembly 40. The damper 62 is generally rectangular in shape and has a pair of notches 64 at one end. The damper 62 is made of a ferromagnetic material such as an iron based steel. The damper 62 is orientated such that the end without the notches 64 is substantially adjacent the end of the coil assembly 40 that has only one permanent magnet strip 36 such that the notches 64 are directed toward the other end of the coil assembly 40. The damper 62 diminishes the strength of the magnetic field and the notches 64 set up strong magnetic forces thereat to provide clearer sound from the coil assembly 40. It should be appreciated that the damper 62 is held against the coil assembly 40 due to the magnetic field from the permanent magnet strips 36 and 38.

In operation, the legs 32 of the acoustic fences 30 are disposed in the notches 28 of the acoustic mount 26 to form the channel 34. The first and second permanent magnet strips 36 and 38 are mounted to the acoustic fences 30 by suitable means such as an adhesive bonding agent. The coil assembly 40 is disposed in the channel 34 and mounted to the acoustic mount 26 by suitable means such as an adhesive bonding agent. The damper 62 is placed over an end of the coil assembly 40. The core pieces 42 and 44 of the coil assembly 40 are magnetically polarized to the N polarity of the adjacent faces of the permanent magnet strips 36 and 38. The recesses 50 between the adjacent teeth 52, together with the adjacent permanent magnet strips 36 and 38 thus define magnetic flux bottles or geometric flux shaping forms in each recess 50. Each recess 50, therefore, proximate its center forms effectively a vector source from which flux lines FL, in a radial fan out, extend to the bottom of the coil assembly 40 as illustrated in FIGS. 4 through 6.

Referring to FIG. 4, the flux lines FL are illustrated for the sensor assembly 24 having the coil assembly 40 disposed between two first permanent magnet strips 36. The flux lines FL are generally of the same size and strength to provide a straight field strength.

Referring to FIG. 5, the flux lines FL are illustrated for the sensor assembly 24 having the coil assembly 40 disposed between the first permanent magnet strip 36 and the second permanent magnet strip 38. Since the second permanent magnet strip 38 has a reduced magnetic force, the flux line FL from the second permanent magnet strip 38 is smaller in size and strength than the flux line FL from the first permanent magnet strip 36.

Referring to FIG. 6, the flux lines FL are illustrated for the sensor assembly 24 having the coil assembly 40 disposed between a first permanent magnet strip 36 and the acoustic fence 30 which has a space due to the lack of a permanent magnet strip and the damper 62. The damper 62 diminishes the strength of the magnetic field produced by the first permanent magnet strip 36 such that its flux line FL is smaller in size and strength than the flux line FL for the first permanent magnet strip 36 of FIGS. 4 and 5. A residual flux line FLA from the second permanent magnet strip 38 is generated by the damper 62 and acoustic fence 30 and is smaller in size, shape and strength than the flux line FL opposite thereto.

In operation, the strings 18 of the guitar 12 vary in diameter and as to whether they are wound. As a result, the strings 18 vary as to their effect on the magnetic field. Therefore, the sensor assembly 24 diminishes or reduces the strength of the magnetic field therealong to provide a balanced string output on the pick-up coil 54. It should be appreciated that when a string 18 moves the magnetic field, the flux pattern will change, thus inducing a voltage in the pick-up coil 54.

Referring to FIGS. 2 through 7, the mounting assembly 22 includes at least one first and second aperture 65 and 66 spaced longitudinally and extending through the acoustic mount 26. The mounting assembly 22 also includes a first disc 68 and a second disc 70 disposed adjacent the acoustic mount 26. The first and second discs 68 and 70 are generally star shaped and have a central aperture 72 extending therethrough. The first and second discs 68 and 70 are formed of an electrically non-conductive elastomeric material which is deformable and/or compressible for acoustic and/or mechanical vibration and electrical isolation between the acoustic mount 26 and other portions of the mounting assembly 22. The first and second discs 68 and 70 are each cut in radial fashion about one-quarter ($\frac{1}{4}$) of the diameter of the discs. These radial cuts, typically six in number, identified as 68*a* and 70*a*, act to reduce the resistance to mechanical compression at the peripheral portion of each of the discs 68, 70 as compared to the solid annular portion of the discs 68, 70 which are uncut.

The mounting assembly 22 further includes a mounting bracket 74 disposed adjacent the first and second discs 68 and 70. The mounting bracket 74 extends longitudinally and includes at least one first and second center apertures 76 and 78 extending therethrough. The first and second center apertures 76 and 78 are aligned with the first and second apertures 65 and 66 of the acoustic mount 26. The mounting bracket 74 also includes an end aperture 78 extending therethrough at each end. Preferably, the end apertures 78 have a diameter smaller than a diameter of the center apertures 76 and 78 and are threaded for a function to be described.

The mounting assembly 22 also includes first and second O-rings 80 and 82 disposed in the center apertures 76 and 78, respectively, of the mounting bracket 74. The O-rings 80 and 82 are made of an electrically non-conductive elastomeric material and act as a centering mechanism for mounting studs 98 and 99 to be described.

The mounting assembly 22 further includes a third disc 84 and a fourth disc 86 disposed adjacent the mounting bracket 74. The third disc 84 is generally circular in shape and made of an electrically conductive material. The fourth disc 86 is formed of an electrically non-conductive elastomeric material and shaped similar to the first and second discs 68 and 70. The third and fourth discs 84 and 86 have a thickness less than a thickness of the first and second discs 68 and 70. The third disc 84 also includes a locking washer 88 intimately engaged therewith for providing positive contact between the mounting bracket 74 and a plate 90 to be described.

The mounting assembly 22 also includes an electrically-conductive, longitudinally extending plate 90 functioning as an electrical and static electricity ground. The plate 90 has a pair of apertures 92 spaced longitudinally and extending therethrough. The plate 90 also has an insulated ground wire 94 extending through an aperture 96 in the plate 90. The end of the ground wire 94 is stripped of its insulation and soldered directly to the plate 90 as illustrated in FIG. 3. It should be appreciated that the ground wire 94 is connected to a ground source (not shown).

The mounting assembly 10 further includes a first mounting stud 98 and a second mounting stud 99 to secure the discs 68, 70, 84, 86, plate 90 and mounting bracket 74 to the acoustic mount 26. The mounting studs 98 and 99 are formed of non-magnetic metal material such as brass. The first and second mounting studs 98 and 99 are, preferably, press-fitted into the first and second apertures 65 and 66, respectively, of the acoustic mount 26. The mounting studs 98, 99 extend through discs 84, 86, plate 90, discs 68, 70, O-rings 80 and 82, and apertures 92, and both ends are radially deformed to secure the mounting studs 98, 99 and lock the mounting assembly 22 and sensor assembly 24 together.

The mounting assembly 22 also includes a first or upper housing member 100. The first housing member 100 has a base portion 102 with an elongated aperture 104 extending longitudinally and therethrough. The first housing member 100 also has a pair of side portions 106 disposed adjacent each side of the elongated aperture 104 for receiving the sensor assembly 24 therebetween. The base portion 102 extends longitudinally and has a narrowed or pointed end 108 at one end and a laterally extending enlarged end 110 at the other end. The side portions 106 are spaced laterally and generally parallel to each other and generally perpendicular to the base portion 102. The base portion 102 and side portions 106 are made of plastic or wood. It should be appreciated that the base portion 102 and side portions 106 may be integral.

The base portion 102 has contoured upper and outer edge surfaces. The base portion 102 also has a first aperture 112 extending therethrough and located adjacent each end of the elongated aperture 104. The base portion 102 also has a second aperture 114 extending through the enlarged end 110. Preferably, the apertures 112 and 114 have a counter-sunk portion. The side portions 106 also have at least a portion which is contoured to follow the outer edge surface or periphery of the base portion 104. One of the side portions 106 has a notch or aperture 117 extending therethrough to allow the coaxial cable 58 to extend into the first housing member 100.

Each side portion 106 further has a threaded aperture 116 therein for a function to be described.

The housing member 100 also includes a pads 118 and 120 on a lower or interior surface of the ends 108 and 110, respectively, of the base portion 102. Preferably, the pads 118 and 120 are made of a soft material such as felt cloth or foam rubber.

The mounting assembly 22 also includes a lower or second housing member 122 for cooperating with the first housing member 100. The second housing member 122 extends longitudinally and has a flat edge at one end. The second housing member 122 also has a narrowed or pointed end 126 at the other end similar to the pointed end 108 of the upper housing member 100. The pointed end 126 is spaced outwardly therefrom by a connecting wall 128 interconnecting the pointed end 126 and the remainder of the second housing member 122 and being generally perpendicular thereto. The second housing member 122 has a pair of apertures 130 spaced laterally and aligned with the apertures 116 of the first housing member 100. Preferably, the second housing member 122 is made of a metal material such as brass. The second housing member 122 includes a pad 132 on a lower or interior surface of the pointed end 126. It should be appreciated that the second housing member 122 may include a pad (not shown) on an exterior surface thereof. It should also be appreciated that the pads may be made of a felt or foam rubber material.

The mounting assembly 22 further includes sensor adjusters 132 for adjusting the sensor assembly 24 relative to the elongated aperture 104. Preferably, the sensor adjusters 132 are threaded fasteners such as screws which extend through the first apertures 112 and threadably engage the end apertures 78 in the mounting bracket 74. The sensor adjusters 132 extend through spacers 134 disposed between the upper housing member 100 and the mounting bracket 74. The spacers 34 are tubular members made of a compressible material such as elastomeric tubing. The sensor adjusters 132 may be rotated independently to move each end of the sensor assembly 24 up and down relative to the elongated aperture 104 as illustrated in FIG. 7.

The mounting assembly 22 also includes fasteners 136 to secure the second housing member 122 to the first housing member 100. The fasteners 136 are threaded and extend through the apertures 130 and threadably engage the apertures 116 of the first housing member 100. It should be appreciated that the pointed end 126 may be flexed relative to the fasteners 136 and returned to its original position due to the cantilevered connection.

The mounting assembly 22 further includes a clamp member 138 for adjustably securing the first housing member 100 to the guitar 12. The clamp member 138 is generally L-shaped and has an outer edge or periphery contoured to match the edge surface of the enlarged end 110 of the housing member 100. The clamp member 138 includes a pad 142 on an upper or interior surface thereof. The pad 142 is made of a felt or foam rubber material. The clamp member 138 also includes at least one, preferably a plurality of, clamp apertures 140 extending therethrough and being threaded. The mounting assembly 22 also includes a clamp adjuster 144 for adjusting the clamp member 138. The clamp adjuster 144 is a threaded fastener such as a screw which threadably engages one of the clamp apertures 140 in the clamp member 138. The clamp adjuster 144 extends through the second aperture 114 in the first housing member 100 and through a spacer 146 disposed between the first housing member 100 and clamp member 138. It should be appreciated that the spacer 146 is similar to spacers 134.

Figure 8:
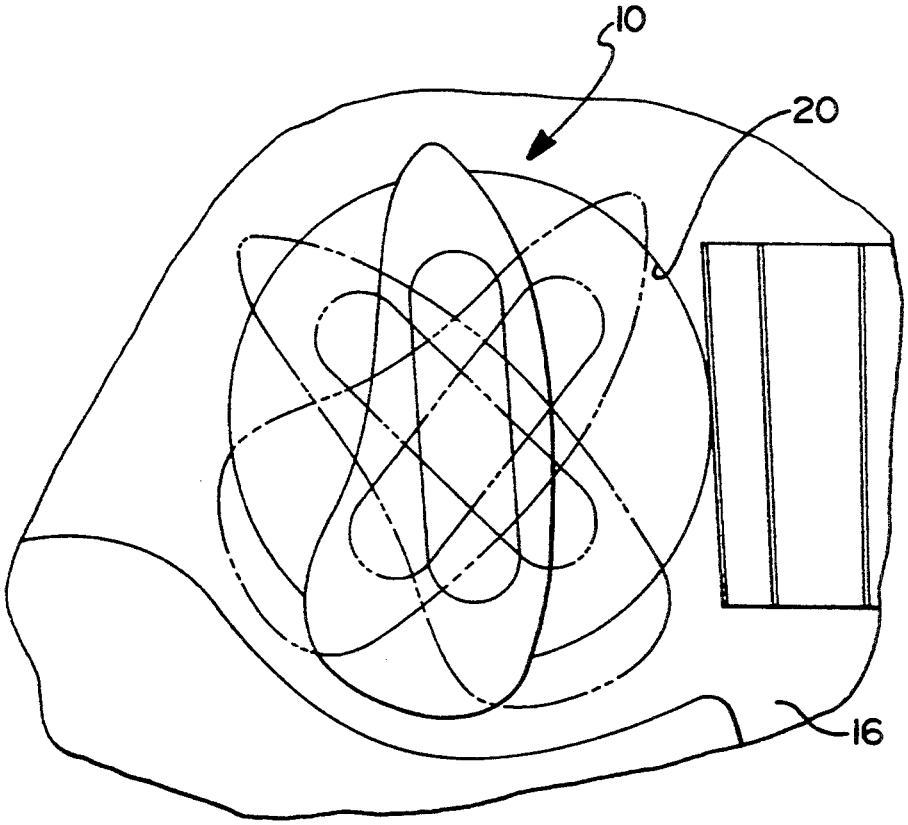
FIG. 8 is a partial plan view of a portion of FIG. 1 illustrating the acoustic pick-up assembly mounted in different positions relative to the stringed musical instrument.

In operation, the acoustic pick-up assembly 10 is disposed in the sound hole 20 of the body portion 16 of the guitar 12. A portion of the body portion 16 is first disposed between the pads 118 and 132 of the pointed ends 108 and 126, respectively, of the first and second housing members 100 and 122. Next, another portion of the body portion 16 is disposed between the pads 120 and 142 of the housing member 100 and clamp bar 138, respectively, as illustrated in FIG. 7. The acoustic pick-up assembly 10 may then be rotated for picking up different vibrations or sounds from the guitar 12 as illustrated in phantom lines in FIG. 8. Once the acoustic pick-up assembly 10 is positioned, the clamp adjuster 144 is rotated with a tool such as a screwdriver to move the clamp bar 138 toward the first housing member 100. As a result, the spacer 146 is compressed to sandwich the body portion 16 between the base portion 102 and clamp bar 138. The pads 120 and 142 prevent damage such as scratches to the body portion 16.

Once the acoustic pick-up assembly 10 is securely clamped, the sensor adjusters 132 may be rotated with a tool such as a screwdriver to move the sensor assembly 24 toward or away the elongated aperture 104 as illustrated in FIG. 7 to obtain a desired sound from the guitar 12. It should be appreciated that the elongated aperture 104 may be closed by a sheath 148 to protect the sensor assembly 24 from entry of foreign matter.

Additionally, electrostatic shielding is provided by the third disc 84, washer 82 and plate 90 which greatly reduces the random "popping" noises due to accumulating electrostatic charges. The plate 90 has a ground wire 94 which is grounded for "draining" away such relatively large electrostatic voltage charges prior to reaching an "avalanche" or break-down point which would result in a rapid discharge of the accumulated electrostatic charge and induce one or more "pops" in the acoustic pick-up assembly 10.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An acoustic pick-up assembly for a stringed musical instrument having a plurality of moveable strings with diameters from a large diameter to a small diameter comprising:

means for forming a longitudinal channel;

magnet means disposed in said channel for producing a magnetic field;

coil means disposed in said channel for receiving an induced voltage due to movement of the moveable strings across the magnetic field; and means for reducing the strength of the magnetic field along said channel to balance the induced voltage from the large diameter strings relative to the small diameter strings into said coil means.

2. An acoustic pick-up assembly as set forth in claim 1 wherein said magnet means comprises at least one first magnet strip mounted to an interior of said channel forming means.

3. An acoustic pick-up assembly as set forth in claim 2 wherein said magnet means comprises at least one second magnet strip mounted to an interior of said channel forming means.

4. An acoustic pick-up assembly for a stringed musical instrument having a plurality of moveable strings with diameters from a large diameter to a small diameter comprising:

means for forming a longitudinal channel;

magnet means disposed in said channel for producing a magnetic field;

coil means disposed in said channel for receiving an induced voltage due to movement of the moveable strings across the magnetic field;

means for reducing the magnetic field along said channel to balance the induced voltage from the large diameter strings relative to the small diameter strings into said coil means;

said magnet means comprising at least one first magnet strip mounted to an interior of said channel forming means and at least one second magnet strip mounted to an interior of said channel forming means; and wherein said reducing means comprises said second magnet strip having a magnetic force less than said first magnet strip.

5. An acoustic pick-up assembly for a stringed musical instrument having a plurality of moveable strings comprising:

means for forming a longitudinal channel;

at least one magnet disposed in said channel for producing a magnetic field;

at least one coil disposed in said channel for receiving an induced voltage due to movement of the moveable strings across the magnetic field; and a damper disposed over a portion of said at least one coil.

6. An acoustic pick-up assembly for a stringed musical instrument having a plurality of moveable strings with diameters from a large diameter to a small diameter comprising:

means for forming a longitudinal channel;

at least one magnet disposed in said channel for producing a magnetic field;

at least one coil disposed in said channel for receiving an induced voltage due to movement of the moveable strings across the magnetic field;

means for reducing the magnetic field along said channel to balance the induced voltage from the large diameter strings relative to the small diameter strings into said coil means; and wherein said channel forming means comprises an acoustic mount extending longitudinally and an acoustic fence disposed along each longitudinal edge of said acoustic mount.

7. An acoustic pick-up assembly as set forth in claim 6 wherein said acoustic mount has a pair of longitudinally spaced notches along each longitudinal edge.

8. An acoustic pick-up assembly as set forth in claim 7 wherein said acoustic fence has a pair of longitudinally spaced legs disposed in said notches.

9. An acoustic pick-up assembly for a stringed musical instrument having a plurality of moveable strings with diameters from a large diameter to a small diameter comprising:

means for forming a longitudinal channel;

magnet means disposed in said channel for producing a magnetic field;

coil means disposed in said channel for receiving an induced voltage due to movement of the moveable strings across the magnetic field;

means for reducing the magnetic field along said channel to balance the induced voltage from the large diameter strings relative to the small diameter strings into said coil means; and wherein said coil means comprises a pair of longitudinally extending core pieces having a plurality of spaced projections along one edge thereof.

10. An acoustic pick-up assembly as set forth in claim 9 wherein said core pieces are generally C-shaped and a spacer disposed therebetween in a back to back relationship.

11. An acoustic pick-up assembly as set forth in claim 10 wherein said coil means further comprises a coil wrapped around said core pieces.

12. An acoustic pick-up assembly for a stringed musical instrument having a plurality of moveable strings comprising:

means for forming a longitudinal channel;

first and second magnets disposed in said channel for producing a magnetic field;

coil means disposed in said channel for receiving an induced voltage due to movement of the moveable strings across the magnetic field; and said second magnet having a magnetic force less than said first magnet for reducing the magnetic field along said channel to balance the induced voltage from the strings into said coil means.

13. An acoustic pick-up assembly as set forth in claim 12 wherein said reducing means comprises a damper disposed over a portion of said coil means.

14. An acoustic pick-up assembly as set forth in claim 12 wherein said channel forming means comprises an acoustic mount extending longitudinally and an acoustic fence disposed along each longitudinal edge of said acoustic mount.

15. An acoustic pick-up assembly as set forth in claim 14 wherein said acoustic mount has a pair of longitudinally spaced notches along each longitudinal edge.

16. An acoustic pick-up assembly as set forth in claim 15 wherein said acoustic fence has a pair of longitudinally spaced legs disposed in said notches.

17. An acoustic pick-up assembly as set forth in claim 12 wherein said coil means comprises a pair of longitudinally extending core pieces have a plurality of spaced projections along one edge thereof.

18. An acoustic pick-up assembly as set forth in claim 17 wherein said core pieces are generally C-shaped and a spacer disposed therebetween in a back to back relationship.

19. An acoustic pick-up assembly as set forth in claim 18 wherein said coil means further comprises a coil wrapped around said core pieces.

20. An acoustic pick-up assembly for a stringed musical instrument having a plurality of moveable strings comprising:

an acoustic mount extending longitudinally and an acoustic fence disposed along each longitudinal edge of said acoustic mount to form a longitudinal channel;

first and second magnets disposed in said channel for producing a magnetic field;

a pair of longitudinally extending core pieces have a plurality of spaced projections along one edge thereof and C-shaped and a spacer disposed therebetween in a back to back relationship and a coil wrapped around said core pieces disposed in said channel for receiving an induced voltage due to movement of the moveable strings across the magnetic field;

a damper disposed over a portion of said coil and said second magnet having a magnetic force less than said first magnet for reducing the magnetic field along said channel to balance the induced voltage from the strings into said coil.

21. A sensor assembly for a stringed musical instrument having a plurality of moveable strings with diameters from a large diameter to a small diameter comprising:

a case having a longitudinal channel;

at least one magnet disposed in said channel for producing a magnetic field;

at least one coil disposed in said channel for receiving an induced voltage due to movement of the strings across the magnetic field; and a damper disposed over a portion of said at least one coil for reducing the magnetic field along said channel to balance the induced voltage from the large diameter strings relative to the small diameter strings into said at least one coil.

22. A sensor assembly for a stringed musical instrument having a plurality of moveable strings with diameters from a large diameter to a small diameter comprising:

a case having a longitudinal channel;

at least one first and second magnet disposed in said channel for producing a magnetic field;

at least one coil disposed in said channel for receiving an induced voltage due to movement of the strings across the magnetic field; and said at least one second magnet having a magnetic force less than said at least one first magnet for reducing the magnetic field along said channel to balance the induced voltage from the large diameter strings relative to the small diameter strings into said at least one coil.

23. A sensor assembly for a stringed musical instrument having a plurality of moveable strings comprising:

an acoustic mount extending longitudinally and an acoustic fence disposed along each longitudinal edge of said acoustic mount and forming a longitudinal channel;

at least one magnet disposed in said channel for producing a magnetic field; and at least one coil disposed in said channel for receiving an induced voltage due to movement of the strings across the magnetic field.

* * * * *

UNITED STATES PATENT AND TRADEMARK OFFICE

CERTIFICATE OF CORRECTION

PATENT NO. : 5,438,157

DATED : August 1, 1995

INVENTOR(S) : Donald A. Lace, Sr. et al.

It is certified that error appears in the above-indentified patent and that said Letters Patent is hereby corrected as shown below:

On title page, item [56], under "References Cited, U.S. Patent Documents", insert "32,520, 10-87, M.A. Lace".

Signed and Sealed this

Thirty-first Day of October 1995

*Attest:*

*Attesting Officer*

BRUCE LEHMAN

*Commissioner of Patents and Trademarks*